US005712629A

United States Patent [19]

Curtiss, Jr. et al.

[11] Patent Number: 5,712,629

[45] Date of Patent: Jan. 27, 1998

[54] DEVICE FOR INTERFACING POINT OF SALE SYSTEMS WITH EXTERNAL PERIPHERAL UNITS

[75] Inventors: Charles D. Curtiss, Jr., Scottsdale; Donald L. Jackson, Gilbert, both of Ariz.

[73] Assignee: DCNS, Inc., Scottsdale, Ariz.

[21] Appl. No.: 464,323

[22] Filed: Jun. 5, 1995

[51] Int. Cl.[6] ..... G07G 1/14

[52] U.S. Cl. ..... 340/825.5; 340/825.35; 235/382; 235/2; 902/22; 364/918.51

[58] Field of Search ..... 340/825.5, 825.04, 340/825.35, 825.06, 825.07; 364/400, 401 R, 405, 918.51; 235/382, 375, 380, 2; 902/22, 41; 395/828, 835, 882, 311, 824; 307/139, 40, 125

[56] References Cited

U.S. PATENT DOCUMENTS

| | | | |
|---|---|---|---|
| 3,946,220 | 3/1976 | Brobeck et al. | 364/405 |
| 4,410,961 | 10/1983 | Dlugos et al. | 395/842 |
| 4,729,097 | 3/1988 | Takaoka et al. | 364/405 |
| 5,253,345 | 10/1993 | Fernandes et al. | 235/380 |
| 5,258,655 | 11/1993 | May et al. | 307/139 |
| 5,398,191 | 3/1995 | Komai | 364/466 |

FOREIGN PATENT DOCUMENTS

| | | | |
|---|---|---|---|
| 0 033 210 | 8/1981 | European Pat. Off. | 235/379 |

*Primary Examiner*—Michael Horabik
*Assistant Examiner*—William H. Wilson, Jr.
*Attorney, Agent, or Firm*—Donald J. Lenkszus; O'Connor Cavanagh

[57] ABSTRACT

A device (12) for interfacing an external peripheral unit (18) to a store controller (16) and store terminal (14) of a point of sale (POS) system has been provided. The interface device includes an MPU (50) for passively monitoring the data coming from the store terminal without causing any interruption to the POS system. When a specific key sequence indicative of a request for use of the peripheral unit has been detected, the device interrupts the flow of data between the store controller and store terminal and enables the MPU to now send data to the store controller and store terminal. Additionally, the device provides a plurality of data paths for allowing the MPU to read data from the store terminal, for storing and reading data from the store controller, and for transferring data between the MPU and the peripheral unit. By controlling the flow of data between the store controller, the store terminal and the peripheral unit, the interface device allows the peripheral unit to operate automatically with the POS system.

16 Claims, 2 Drawing Sheets

DEVICE FOR INTERFACING POINT OF SALE SYSTEMS WITH EXTERNAL PERIPHERAL UNITS

BACKGROUND OF THE INVENTION

This invention relates to interface devices for point of sale systems and, in particular, to interface devices coupled between a point of sale terminal and its corresponding store controller for allowing external peripheral units to attach to and operate with the point of sale system.

Point of sale systems, such as those commonly found in grocery stores and other business establishments, include a store controller for processing data and at least one point of sale terminal for inputting data and transferring data to and from the store controller. The controller typically is located in a back room or some other area of the store not visible to the customer. The terminals are located in the store, such as in a checkout lane, where the customer exchanges cash or some other form of payment, such as a debit or credit card, for the goods purchased. The sales transaction is performed at these terminals - hence the name "point of sale" terminals/systems.

Point of sale systems were introduced into the marketplace in the early 1970's. The early systems, such as those manufactured by National Semiconductor's Datachecker Division, were key-entry type systems requiring the store checkout clerk to manually enter by keystroke the price of the item being purchased. Several years later, Datachecker's terminals, as well as others, were modified to include scanners for reading a bar code affixed to the product while the store controller automatically generated the price.

These point of sales systems were designed to be "closed systems". A "closed system" generally refers to a system that was not designed to facilitate the addition or attachment of external peripheral units unless they were supplied by the manufacturer. As a result, if a user of these closed systems desires to expand the capability of the system to include additional or improved peripheral units, such as printers, scanners, electronic fund transfer units, magnetic ink character recognition units, video display units, or a cash drawer, the user must either (1) purchase such additional units from the original manufacturer of the closed system, or (2) purchase a new system already including such additional peripheral units, or one at least having the capability to attach such peripheral units thereto. However, both options can be quite expensive. Unfortunately, the user of such closed systems does not have the option of simply purchasing the most economical and state-of-the-art off-the-shelf external peripheral units for use with the closed system.

It is therefore a principal object of the present invention to provide an interface device that can be used with point of sales systems to allow the user to attach a wide variety of off-the-shelf external peripherals to an existing or newly purchased point of sale system at a relatively low cost thereby enhancing the capability as well as increasing the longevity of the point of sale system.

SUMMARY OF THE INVENTION

It is an object of the present invention to provide an interface device for enhancing the capability of point of sale systems.

It is another object of the present invention to provide an interface device coupled to the communication line between a store terminal and its corresponding store controller to allow attachment of a wide variety of off-the-shelf external peripherals to the point of sale system.

Still another object of the present invention is to provide an interface device for point of sale systems for enhancing the capability of the point of sale system by allowing external peripheral units to be attached thereto and for increasing the longevity and useful life of the point of sale system.

Briefly, the present invention provides a device for enhancing the capability of point of sale (POS) systems. The present invention includes an interface that is coupled between the communication line of a point of sale terminal and its corresponding store controller for enabling the system to attach to and operate with an external peripheral unit such as an electronic fund transfer unit. The interface includes a microprocessor unit (MPU) for passively monitoring the data coming from the store terminal without causing any interruption to the POS system. When a specific key sequence indicative of a request for an electronic fund transfer (EFT) transaction has been detected, the device interrupts the flow of data between the store controller and store terminal and enables the MPU to send data to the store controller and store terminal. Additionally, the device provides a plurality of data paths for allowing the MPU to read data from the store terminal, for storing and reading data from the store controller, and for transferring data between the MPU and the EFT unit. By controlling the flow of data between the store controller, the store terminal and the EFT unit, the interface device allows the EFT unit to automatically operate with the POS system.

BRIEF DESCRIPTION OF THE DRAWINGS

The above and still further objects, features, aspects and attendant advantages of the present invention will become apparent from consideration of the following detailed description in conjunction with the accompanying drawings, in which.

DETAILED DESCRIPTION OF THE PREFERRED EMBODIMENT

Figure 1:
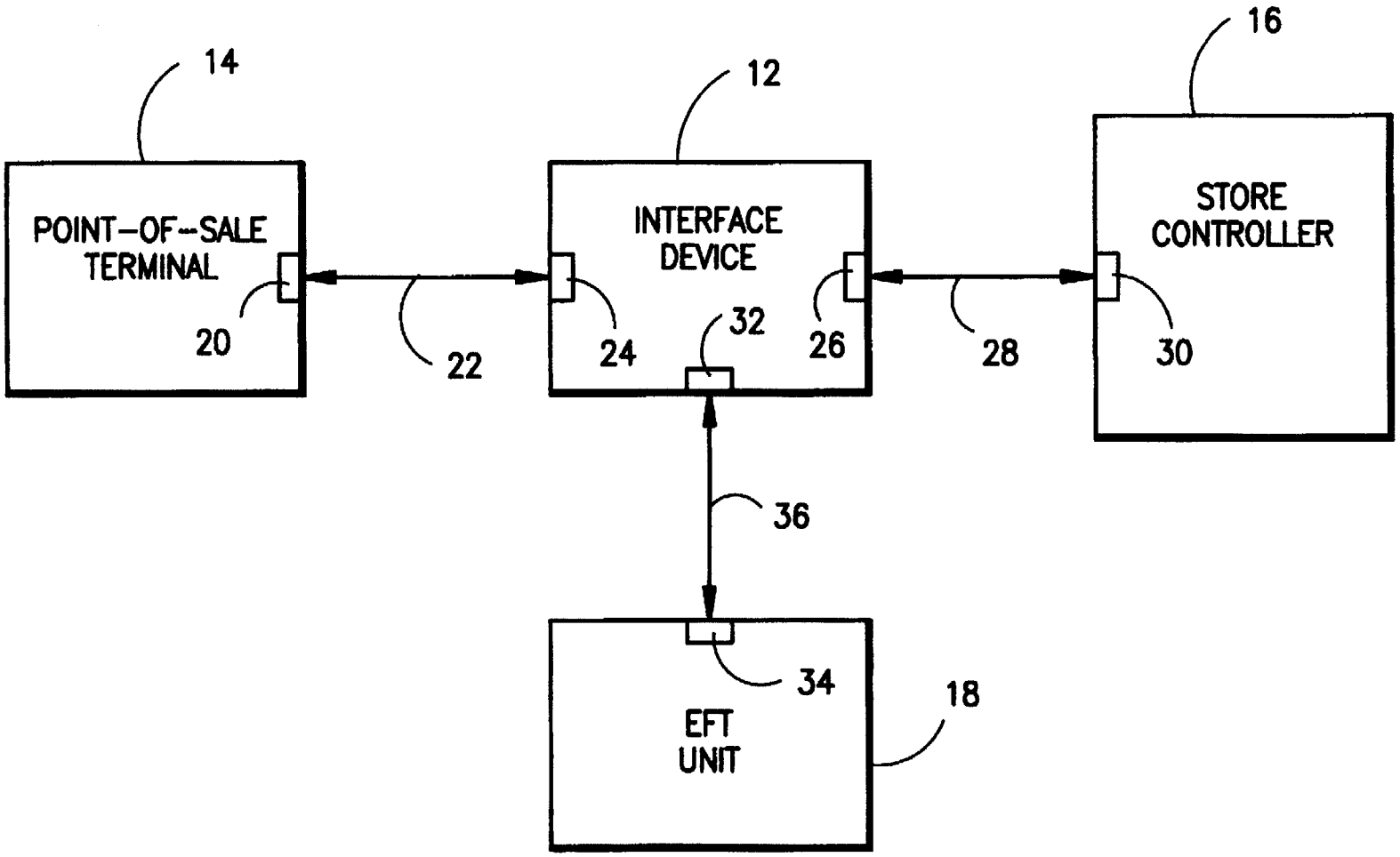
FIG. 1 is a simplified block diagram depicting an interface device coupled to a point of sale system for allowing an external peripheral unit to be attached thereto.

The present invention includes an interface device that is inserted within the communication line between a store terminal and its store controller of a point of sale (POS) system for allowing an external peripheral unit to attach to and communicate with the POS system. Moreover, unless the interface device is activated, it does not interfere with the normal flow of data between the store terminal and controller thereby making the interface device transparent to normal operation of the POS system. Referring to FIG. 1, a simplified block diagram illustrating interface device 12 coupled to the communication line between POS terminal 14 and its corresponding store controller 16 for allowing external peripheral unit 18 to be attached thereto. Point of sale terminal 14 may take the form, for example, of ICL Datachecker terminal model type numbers 2000, 2001, 3000 and 9520. POS terminal 14 includes connector 20 for coupling terminal 14 to interface device 12 via cable 22 and connector 24 of interface device 12. Connectors 20 and 24 may take the form, for example, of a DB-25 connector manufactured by Amp having part number 747842-4. DB-25 connectors are conventional connectors well known in the art having the capability for accommodating up to twelve (12) differential pair signals. interface device 12 further includes connector 26 for coupling to store controller 16 via cable 28 and connector 30 of controller 16. Again, connectors 26 and 30 may be, for example, DB-25 connectors. Store controller 16 may take the form, for example, of ICL Datachecker model type numbers 1500, 1600, 1700, and 1800.

Interface device 12 is also coupled to peripheral unit 18 via connectors 32 and 34 and cable 36. In a preferred embodiment, connector 32 takes the form of an RJ45 8-pin connector for allowing interface device 12 to be connected to an external peripheral unit having either (1) an RS 232 interface connector, or (2) an RS 485 interface connector. This feature will be discussed in more detail hereinafter.

In a preferred embodiment, external peripheral unit 18 takes the form of an electronic fund transfer (EFT) unit such as the Verifone, Inc. Model No. 490. However, it is understood that the present invention provides an interface device for coupling point of sale systems to a plurality of different external peripheral units such as any off-the-shelf components for use with POS systems including electronic fund transfer units, video display units, printers, scanners, and magnetic ink character recognition units.

Briefly, most of the time, data transferred between POS terminal 14 and controller 16 is uninterrupted by interface device 12 and is unaffected by its presence. Thus, most of the time, device 12 is transparent and does not interfere with the operation of the POS system. Interface device 12 does passively monitor the data coming from terminal 14 looking for a data pattern indicative of a specific terminal key such as the total key. Once this specific data pattern is detected, interface device 12 activates circuitry to interrupt the flow of data between terminal 14 and controller 16, and to enable device 12 to send data to and receive data from both terminal 14 and controller 16. Additionally, interface device 12 controls the flow of data to and from EFT unit 18 through connector 32. In this manner, device 12 functions as an interface for allowing an external peripheral unit, such as EFT unit 18, to attach to and operate with terminal 14 and store controller 16.

Figure 2:
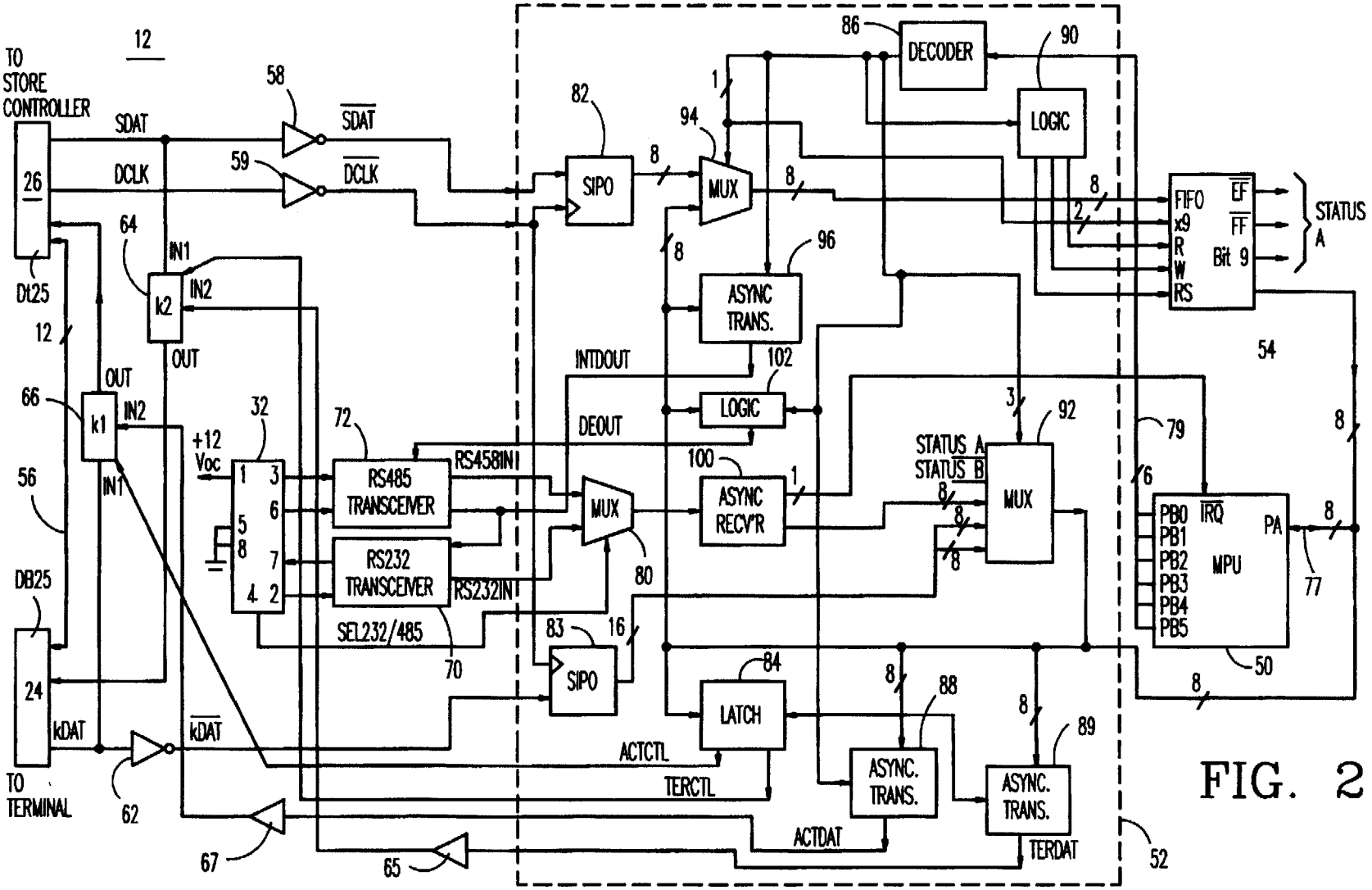
FIG. 2 is a detailed block diagram of the interface device of FIG. 1.

Referring now to FIG. 2, a detailed block diagram of interface device 12 is shown. Components shown in FIG. 2 that are identical to components shown in FIG. 1 are identified by like reference numbers. Interface device 12 includes microprocessor unit (MPU) 50 which may take the form, for example, of a surface mounted device with part number 68HC705J2 manufactured by Motorola. MPU 50 includes one 8-bit parallel port as designated by port A (PA), and one 6-bit parallel port as designated by port B (PB). The least significant bit of port B is represented as PB0 while the most significant bit of port B is represented as PB5. Similar terminology exists for port A as well with PA0 and PA7 representing the least and most significant bits, respectively. MPU 50 also includes an interrupt request input (IRQ) for interrupting the microprocessor.

Device 12 also includes various logic circuitry as shown in dotted box 52. All of the logic circuitry within dotted box 52 may be implemented in a field programmable gate array (FPGA) such as the A1020BPL68C manufactured by Actel.

First-in first-out (FIFO) memory 54 is coupled to logic circuitry/FPGA 52 for storing input data and for providing such data at its output to bi-directional port A of MPU 50. In a preferred embodiment, FIFO 54 must be capable of storing at least 1024×9 bits of data and may take the form of any 7202-type FIFO.

Connectors 24 and 26 are respectively coupled to terminal 14 and controller 16 both of which are shown in FIG. 1. Most of the signals between the store controller and the terminal flow directly to and from connectors 24 and 26 as indicated by lines 56. However, two store controller signals, (1) store data signal (SDAT), and (2) data clock signal (DCLK), are tapped off from connector 26 and are coupled to interface device 12. These signals are respectively passed through line receivers 58 and 59 for converting data from store controller 816 to appropriate logic level signals, such as TTL logic level signals, to be sent to FPGA 52.

Likewise, POS signal terminal data, KDAT, is tapped off connector 24 to be supplied to interface device 12. The terminal data passes through line receiver 62 and is supplied to FPGA 52.

Relay 64 provides a means for interrupting the flow of signal SDAT from the store controller to the POS terminal as well as a means for allowing interface device 12 to send data to the terminal. Relay 64 has a first input coupled to receive the serial data from the store controller and a second input coupled to receive data TERDAT from MPU 50 and FPGA 52 via line driver 65. The output of relay 64 is coupled to a pin of connector 24 (which is coupled to terminal 14 of FIG. 1). The switching of relay 64 is controlled by MPU 50 and FPGA 52 via control signal TERCTL.

Generally, relay 64 is not energized and serial data SDAT flows through relay 64 to connector 24 as if interface device 12 was not present. However, when interface device 12 is activated the conditions of which will be discussed hereinafter, relay 64 is energized, via control signal TERCTL, and passes data signal TERDAT to its output and eventually to terminal 14 via connector 24. In this manner, relay 64 serves the dual purpose of preventing the store controller from sending data to the terminal when device 12 is activated as well as a means for allowing interface device 12 to transmit data to the terminal.

Likewise, relay 66 provides a means for interrupting the flow of signal KDAT from the terminal to the store controller as well as a means for allowing interface device 12 to send data to the store controller. Relay 66 has a first input coupled to receive signal KDAT from the store terminal and a second input coupled to receive data ACTDAT from MPU 50 and FPGA 52 via line driver 67. The output of relay 66 is coupled to a pin of connector 26. The switching of relay 66 is controlled by MPU 50 and FPGA 52 via control signal ACTCTL.

Generally, relay 66 is not energized and data KDAT appearing at the first input of relay 66 is passed to connector 26 and eventually to store controller 16. However, when relay 66 is energized, via control signal ACTCTL, data ACTDAT appearing at the second input of relay 66 is passed to connector 26. In this manner, relay 66 serves the dual purpose of preventing terminal 14 from transmitting, to the store controller, any keystrokes or other input data such as a bar code scan that the clerk may initiate when interface device 12 is activated, and receiving serial data from the store controller as well as allowing interface device 12 to transmit data to the store controller.

Connector 32 may be, for example, an RJ45 jack that is used for connecting interface device 12 to EFT unit 18 (of FIG. 1). Connector 32 is an 8-pin connector, which may take the form, for example, of part number RJ45-8L-B manufactured by Corcom, capable of transferring either (1) RS 232 formatted data between EFT unit 18 and interface device 12, or (2) RS 485 formatted data between EFT unit 18 and interface device 12. To that end, pins 2 and 7 are utilized for transferring RS 232 formatted data between EFT unit 18 and interface device 12 while pins 3 and 6 are utilized for transferring RS 485 formatted data between EFT unit 18 and interface device 12. Connector 32 also includes pin 4 which may be tied either high or low to indicate as well as select whether connector 32 is receiving RS 232 or RS 485 formatted data. Pin 1 of connector 32 may be tied to a predetermined voltage, such as 12 volts, for supplying an operating voltage to interface device 12. Pins 5 and 8 are grounded.

RS 232 transceiver 70 is provided for translating RS 232 signals via pin 2 of connector 32 to logic level signal RS232IN, such as TTL, to be supplied to FPGA 52. In a similar manner, logic level signal INTDOUT from FPGA 52 is translated to an RS 232 signal and supplied to pin 7 of connector 32. RS 232 transceiver 70 may be, for example, part number MAX202CSE manufactured by Maxim.

Likewise, RS 485 transceiver 72 is provided for translating a differential RS 485 signal appearing across pins 3 and 6 of connector 32 to a single-ended logic level signal RS 485 IN that is applied to FPGA 52. In a similar manner, logic level signal INTDOUT from FPGA 52 is translated to a differential RS 485 signal and supplied to pins 3 and 6 of connector 32. Signal DEOUT is a logic control signal supplied to transceiver 72 for determining the direction of data flow through transceiver 72. For example, if control signal DEOUT is a logic low, RS 485 data is received from connector 32 and translated to logic level signal INTDOUT that is supplied to FPGA 52. On the other hand, if control signal DEOUT is a logic high, logic level signal RS485 IN is received from FPGA and translated to RS 485 data that is supplied to connector 32. RS 485 transceiver 72 may be, for example, part number MAX487CSA manufactured by Maxim.

The logic circuitry within block 52 includes circuitry for providing and controlling data paths for transferring data between connector 26 (i.e., the store controller) and MPU 50, between connector 24 (i.e., the store terminal) and MPU 50, and between connector 32 (i.e., the EFT unit) and MPU 50. These data paths will now be discussed in detail.

Generally, port A and bi-directional bus 77 allow for data to be transferred to or from MPU 50, while port B and bus 79 provide various command/control signals to logic circuitry 52 for activating or enabling various logic components and for controlling the path of data appearing on bus 77.

Interface device 12 provides a data path for MPU 50 to receive data from the store terminal. Interface device 12 receives terminal data KDAT via line receiver 62 and Serial In Parallel Out (SIPO) device 83. SIPO 83 receives serial KDAT data and provides a 16 bit word to multiplexor (MUX) 92 by way of two 8-bit byte inputs. In order for MPU 50 to receive and monitor such terminal data, appropriate data is sent out via port B to decoder 86 for selecting one of the two 8-bit bytes corresponding to the terminal data. MUX 92 outputs such terminal data on bus 77 to be read by MPU 50 on port A. Thus, MPU 50 receives data from the store terminal via the components line receiver 62, SIPO 83, MUX 92 and bus 77.

Interface device 12 also provides a path for receiving data from the store controller and storing such data in FIFO 54 which may be subsequently read by MPU 50 via bus 77. Store controller data, SDAT, is serial data that is received by SIPO 82 for providing 8-bit inputs to MUX 94. In order to store this data into FIFO 54, MPU 50 sends an appropriate data signal on port B to decoder 86 to cause MUX 94 to pass the output of SIPO 82, and to cause logic circuit 90 to generate a write signal to FIFO 54. Additionally, a ninth bit is stored with each byte of the store controller data. This ninth bit is the same logic level of the bit that controls the selection of MUX 94. In this manner, the ninth bit is used to designate whether a byte of data stored in FIFO 54 came from the store controller or from the MPU (the other input to MUX 94).

Assuming that MPU 50 wanted to read such data from the store controller, it would initiate appropriate command signal data on its port B to cause decoder 86 to provide the proper logic signals to logic circuit 90 to read the memory contents of FIFO 54. Thus, MPU can receive data from the store controller via components SIPO 83, MUX 94 and FIFO 54.

As was mentioned earlier, the other input to MUX 94 is data on bus 77. Accordingly, data from MPU 50 via bus 77 can also be stored in FIFO 54. The ninth bit that is stored in FIFO 54, however, will be the opposite logic level than that stored in FIFO 54 for data originating from store controller. This allows MPU 50 to quickly and easily distinguish whether data stored in FIFO 54 was data from the store controller or data from MPU 50.

Interface device 12 also provides a path for MPU 50 to receive data from the EFT unit. MUX 80 is utilized for selecting between RS 232 or RS 485 formatted data. If RS 232 data is to be received, via connector 32, then pin 4 of connector 32 is tied to a logic low voltage level and MUX 80 passes signal RS232IN to its output. However, if RS 485 data is to be received, then pin 4 of connector 32 is tied to a logic high voltage level, and MUX 80 passes signal RS 485 IN to its output. The selected data format appearing at the output of MUX 80 is sent to an input of asynchronous receiver 100 which receives the serial data and provides an 8-bit output to MUX 92. In a similar manner that MPU 50 received terminal data KDAT, MPU 50 may receive data from connector 32 (i.e., the EFT unit) via bus 77. Receiver 100 also provides an interrupt signal to MPU 50 when data from the EFT unit is received thereby allowing MPU 50 to quickly tend to such data before it is lost. Thus, MPU 50 can read data from the EFT unit via the components RS 232 transceiver 70 (or RS 484 transceiver 72), MUX 80, asynchronous receiver 100, MUX 92 and bus 77.

MUX 92 additionally, receives two more 8-bit byte inputs as designated by STATUS A and STATUS B inputs. Included within the STATUS A and STATUS B bytes are three bits taken from the output of FIFO 54 including an empty flag (EF) bit that is asserted when FIFO 54 is empty, a full flag (FF) bit that is asserted when FIFO 54 is full, and a "Bit 9" bit for designating whether the data byte stored in FIFO 54 originated from the store controller or MPU 50 as discussed above. Additionally, STATUS A and STATUS B bytes also include bits for indicating whether (1) connector 32 is transferring RS 232 or RS 485 data, (2) the asynchronous transmitter 88 is empty, (3) data in asynchronous receiver 100 is ready, (4) asynchronous transmitter 96 is empty, (5) the printer is not ready, (6) the store terminal is not ready, and (7) data in SIPO 83 is ready. In a similar manner as described for the other inputs to MUX 92, these STATUS A and STATUS B bytes may be read by MPU 50 via bus 77 and port A to obtain various information about the status of certain components and signals of interface device 12.

Thus far, the data paths within interface device 12 for allowing interface device 12 to receive data from either the store terminal, the store controller, or the EFT unit has been described. In a similar manner, but different data paths, interface device 12 is capable of sending/transmitting data to the store terminal, the store controller and the EFT unit. These data paths will now be described.

Interface device 12 provides a path for MPU 50 to send data to the store terminal when relay 64 is energized by control signal TERCTL. In order to energize relay 64, MPU 50 sends out appropriate data on port B, which is decoded by decoder 86, for enabling latch 84 to store the data appearing on bus 77, via port A, indicative of the logic state of control signal TERCTL. In this manner, control signal TERCTL may be used to energize relay 64.

MPU 50 then selects asynchronous transmitter 89 via port B and decoder logic 86 to receive the data sent out on bus 77 from its port A. Asynchronous transmitter 89 receives the 8-bit parallel data from MPU 50 and provides such data in a 25 serial format through relay 64 to connector 24 (and ultimately to the store terminal). Thus, MPU 50 can send data to the store terminal via the components bus 77, asynchronous transmitter 89, line driver 65 and relay 64 when control signal TERCTL energizes relay 64.

Interface device 12 provides a path for MPU 50 to send data to the store controller when relay 66 is energized by control signal ACTCTL. Latch 84 includes an additional latch for storing the logic value of control signal ACTCTL for use in energizing relay 66. This allows control signals TERCTL and ACTCTL to be different logic levels for independently energizing relays 64 and 66. Similar to sending data to the store terminal, MPU 50 may send data to the store controller when relay 66 is energized via the components bus 77, asynchronous transmitter 88, line driver 67 and relay 66.

Finally, interface device 12 provides a path for MPU 50 to send data to connector 32 (i.e., the EFT unit). MPU 50 sends appropriate data to decoder 86 via port B to activate asynchronous transmitter 96 to receive the data appearing on bus 77 from via port A of MPU 50. Asynchronous transmitter 96 provides a serial data stream at its output via interface data out signal INTDOUT. This output signal of transmitter 96 is sent to both RS 232 transceiver 70 and RS 485 transceiver 72 for transfer to connector 32. It does not matter that signal INTDOUT is sent to both transceivers because the EFT unit will be connected to the pins corresponding to one of the formats and the pins corresponding to the other format will not be connected to any device. Thus, in the case of selecting RS 232 formatted data, data signal INTDOUT is passed through RS 232 transceiver 70 to pin 7 and the data appearing at pins 3 and 6 will have no effect. In the case of selecting RS 485 formatted data, data signal INTDOUT is passed through RS 485 transceiver 72 to pins 3 and 6 and the data appearing at pin 7 will have no effect. Additionally, in the case of selecting RS 485 formatted data, interface device 12 must provide logic signal DEOUT to RS 484 transceiver 72 to select the appropriate direction of data transfer. Generally, the default direction is data flowing from connector 32 to MUX 80 so as to always allow device 12 to receive data from the EFT unit. However, when it is desired to transfer data from transceiver 72 to the EFT unit, MPU 50 sends appropriate data at its port B to select and activate a logic circuit 102 to receive data on bus 77 for asserting signal DEOUT and changing the flow of data through transceiver 72. Thus, MPU 50 can send data to the EFT unit via the components bus 77, asynchronous transmitter 96 and RS 232 transceiver 70 (or RS 485 transceiver 72).

It is worth noting that there are three separate data clocking signals. The first clock signal, DCLK, which comes from the store controller, is used to clock data into SIPO 82, SIPO 83, and to clock data out of asynchronous transmitters 88 25 and 89. This clocking rate is determined by the store controller and may vary depending upon the model. The second clock signal (not shown), which is generated within interface device 12, is used to clock data into asynchronous receiver 100. It is eight times the bits per second (bps) rate of incoming data via MUX 80. The third clock signal (not shown), derived from the second clock signal, is used to clock data out of the asynchronous transmitter 96. The rate of the second and third clock signals is determined by the external device 18, but typically the rate of the third clock signal is 9600 bps.

Thus, it has now been demonstrated the data paths within interface device 12 for allowing device 12 to both send and receive data to and from the store terminal, the store controller, or the EFT Unit.

What will be described now is an example of one of many ways that interface device 12 may function for allowing an EFT unit coupled to connector 32 to interface with a point of sale system that includes a store terminal connected through connector 24 and a store controller connected through connector 26. Since all data paths have already been described, the discussion can be limited to the type of data transferred and the function performed by interface device 12 without going into detail of how the data is transferred. For example, when it is said that MPU 50 reads data from the store terminal, it is apparent from the above discussion that this is accomplished by tapping off serial data KDAT from connector 24, converting it from a serial to parallel format via SIPO 83, and sending the parallel data to port A of MPU 50 by way of MUX 92 and bus 77.

Initially, interface device 12 is passive in that relays 64 and 66 are de-energized such that store data SDAT flows from connector 26 through relay 64 to connector 24. Likewise, terminal data KDAT flows from terminal 24 through relay 66 to connector 26. Interface device 12 does not affect the operation of the POS system at this point, but MPU 50 does passively read and monitor terminal data KDAT for a specific key sequence pattern representing a request for an EFT transaction. The specific key sequence may be simply the store clerk pressing the total key or any predetermined key or sequence of keys. Alternately, interface device 12 may be programmed to allow MPU 50 to monitor a predetermined key sequence or data pattern from the EFT unit or the store controller indicative of a request for an EFT transaction. Once the MPU detects the predetermined key sequence indicative of a request by the store clerk for an EFT transaction, then MPU 50 energizes relay 66 to prevent additional terminal data from being sent to the store controller and to allow MPU 50 to send its own data to the store controller. Note however that although the path for terminal data to be sent store controller has been interrupted, interface device 12 still has the capability to monitor the terminal data via SIPO 83 and MUX 92.

MPU 50 then sends data to the store controller to clear the last entry from the terminal that was sent to the store controller (i.e., the key sequence for requesting an EFT transaction).

In response thereto, the store controller sends a couple of bytes of control information back to the terminal which are detected by MPU 50 via store controller data SDAT. One specific control code, for example, to watch for is the code for "turn off the error light" on the clerks keyboard. Once this code is detected in response to the "error clear" code which was sent to the store controller, it is safe to energize relay 64 without interrupting data being sent by the store controller to the store terminal. At this point, interface device 12 energizes relay 64 for interrupting the flow of store controller data SDAT to the terminal while enabling MPU 50 to send data to the store terminal. MPU 50 now has full control over sending data to and receiving data from both the store terminal and the store controller. In addition, MPU 50 has the capability to both send data to and receive data from the EFT unit through the data paths described above.

Interface device 12 now needs to know the total of the sales transaction. This is accomplished by MPU 50 sending to the store controller a key sequence indicative of the total key. This has the same effect on the store controller as if the clerk at the terminal hit the total key.

The store controller responds with the total amount of the sale and sends that information to MPU 50 via signal SDAT.

Interface device 12 now needs to know the card type or transaction type that is going to take place. To accomplish this, MPU 50 sends a data packet to the EFT unit to request the card type (i.e., a credit card, a debit card or a Discover card).

The EFT unit responds with a data packet that includes information such as the type of credit or debit card as well as the card number. As mentioned earlier, this EFT data is received by asynchronous receiver 100 for generating an interrupt request to MPU 50 and MPU 50 immediately reads the data from the EFT unit in the data path as described above.

As MPU 50 is receiving this data from the EFT unit, it is also storing much of this information into FIFO 54 such as any information that is to be displayed or printed on the cash register or cash register receipt.

In the case of a Discover card which is permits a customer to receive cash back, an additional step is performed in that MPU 50 sends a prompt to the store terminal requesting whether the customer desires cash back. Typically, the store clerk either keys in an amount of cash back desired or hits the total key if no cash back is desired.

Further, if this transaction was a check-type transaction rather than a credit card transaction, external peripheral unit 18 could take the form of a magnetic ink character recognition (MICR) unit that is capable of reading the checking account number from the check for use in determining if such a check is a "bad check" and should not be accepted. In this case, store controller 16 would compare the checking account number with a directory of bad checking account numbers (i.e., account numbers where checks have bounced before) to determine whether the store should accept such a check.

At this point, MPU 50 sends another data packet to the EFT unit for requesting authorization to charge the total amount to the identified debit or credit card.

In due time, the EFT unit responds back with a data packet indicating whether the transaction was approved as well as information that will get printed on the cash register receipt, such as the total amount authorized, the card type and card number. Generally, the EFT unit generates one receipt for the customer to sign (if it is a credit card transaction) and also sends information to MPU 50 in which MPU 50 stores such information in FIFO 54 for later printing on a receipt at the store terminal. Such receipt printer information typically includes the date, time, card number, approval number and amount.

MPU 50 then sends the approved amount (assuming that the transaction was authorized) to the store controller. The store controller then responds with information that is stored in FIFO 54 for later printing. Such store controller information typically includes the total, amount tendered, change, current receipt trailer, and subsequent receipt header.

MPU 850 then sends data to the store controller indicative of the tender key for use in finalizing the sale. Although the tender key is sent to the store controller, interface device 12 must be careful not to automatically open the cash drawer for obvious reasons of security.

As a final step to end the EFT transaction, interface device 12 de-energizes relays 64 and 66 and the normal signal path between the store controller and the store terminal is restored back to an uninterrupted status.

By now it should be apparent that a novel device for interfacing an external peripheral unit to a store controller and store terminal of a point of sale (POS) system has been provided. The interface device is coupled to the communication line between the store controller and the store terminal as opposed to being coupled only to either the store terminal or the store controller. The interface device includes an MPU for passively monitoring the data coming from the store terminal without causing any interruption to the POS system. When a specific key sequence indicative of a request for use of the peripheral unit has been detected, the device interrupts the flow of data between the store controller and store terminal and enables the MPU to now send data to the store controller and store terminal. Additionally, the device provides a plurality of data paths for allowing the MPU to read data from the store terminal, for storing and reading data from the store controller, and for transferring data between the MPU and the peripheral unit. By controlling the flow of data between the store controller, the store terminal and the peripheral unit, the interface device allows the peripheral unit to operate automatically with the POS system.

Although certain preferred embodiment and methods have been disclosed herein, it will be apparent to those skilled in the art from consideration of the foregoing description that variations and modifications of the described embodiments and methods may be made without departing from the true spirit and scope of the invention. For example, although the preferred embodiment illustrated the external peripheral unit to be an EFT unit, it should be apparent that the interface device provides a plurality of data paths for data transfer to a number of different external peripheral units for use with POS systems such as printers, scanners, magnetic ink character recognition units, video display units or cash drawers. Also, although the preferred embodiment describes the use of only three connectors for interfacing an external peripheral unit to a POS system, it should be apparent that the present invention may include a multiple number of additional connectors for connecting interface device 12 to a plurality of external peripheral units. Accordingly, it is intended that the invention shall be limited only to the extent required by the appended claims and the rules and principles of applicable law.

What is claimed is:

1. A device for interfacing an external peripheral unit to a point of sale (POS) system having a terminal and a controller, said device comprising:

first, second and third connectors, said first connector for coupling to said terminal, said second connector for coupling to said controller, and said third connector for coupling to the external peripheral unit;

a microprocessor unit (MPU);

relay means coupled between the first and second connectors, said relay means in a first state connecting said first and second connectors and in a second state interrupting the flow of data therebetween and enabling transfer of data between said MPU and each of said first and second connectors; and logic circuitry, coupled to and controlled by said MPU, for providing a plurality of data paths between said MPU and the first, second, third connectors to allow the POS system to attach to and communicate with the external peripheral unit, said MPU being responsive to receipt of predetermined signals received by said logic circuitry to operate said relay means to switch from said first state to said second state such that a first data path is established between said first connector and said MPU, a second data path is established between said second connector and said MPU and a third path is established between said third connector and said MPU.

2. The device according to claim 1 further comprising means coupled to the third connector for allowing transfer of a plurality of data formats between said MPU and the third connector.

3. The device according to claim 2, wherein: said third connector includes means for selecting one of said plurality of data formats.

4. The device according to claim 1, wherein said MPU includes first and second input/output (I/O) ports, said first I/O port being bi-directional for receiving and transmitting data via said plurality of data paths, said second I/O port for transmitting data to said logic circuitry for selecting one of said plurality of data paths.

5. The device according to claim 1, wherein: said external peripheral unit is selected from the group consisting of an electronic fund transfer unit, a magnetic ink character recognition unit, a printer, a scanner, a video display unit and a cash drawer.

6. A device for interfacing an external peripheral unit to a point of sale (POS) system having a store terminal and a store controller, the device including a first connector for coupling to the store terminal and a second connector for coupling to the store controller, the device further including a third connector for coupling to the external peripheral unit, comprising:

a microprocessor unit (MPU);

relay means coupled between the first and second connectors and operable in a first state to provide a first data path between said first and second connectors and operable to a second state for selecting interrupting the flow of data therebetween and for establishing data paths between said MPU and each of said first and second connectors for transferring data between said MPU and each of said first and second connectors;

first means for transferring data between said first connector and said MPU;

second means for transferring data between said second connector and said MPU;

third means for transferring data between the third connector and said MPU; and wherein said relay means and said first, second and third means are controlled by said MPU, said relay means being selectively switched between said first and second states by said MPU;

said MPU selectively switch of said relay means in response to predetermined signals at one of said first, second and third connectors.

7. The device according to claim 6 further wherein said third means includes means for allowing transfer of a plurality of data formats between said MPU and the third connector.

8. The device according to claim 7 wherein the third connector includes means for selecting one of said plurality of data formats.

9. The device according to claim 6 wherein the external peripheral unit is selected from the group consisting of an electronic fund transfer unit, a magnetic ink character recognition unit, a printer, a scanner, a video display unit and a cash drawer.

10. A method for allowing an external peripheral unit coupled to a first connector to interface with a point of sale (POS) system having a store terminal and a store controller respectively coupled to second and third connectors, the method comprising the steps of:

passively monitoring data from one of the connectors so as to not interrupt the normal flow of data between the store terminal and the store controller;

detecting a predetermined data pattern from said one of the connectors indicative of a request to access the external peripheral unit;

interrupting the normal flow of data between the store terminal and the store controller in response to said detection of said predetermined data pattern;

providing a plurality of data paths for processing and transferring data between the external peripheral unit, the store terminal and the store controller.

11. The method of claim 10 wherein the step of providing a plurality of data paths includes:

providing data paths for transferring data between a microprocessor unit (MPU) and the store terminal; and providing data paths for transferring data between said MPU and the store controller.

12. The method of claim 10 further including the step of selecting one of a plurality of possible data formats appearing at the third connector.

13. The method of claim 10 wherein the external peripheral unit is selected from the group consisting of an electronic fund transfer unit, a magnetic ink character recognition unit, a printer, a scanner, a video display unit and a cash drawer.

14. The method of claim 10 wherein said one of the connectors is coupled to the store terminal.

15. The method of claim 10 wherein said one of the connectors is coupled to the EFT unit.

16. The method of claim 10 wherein said one of the connectors is coupled to the store controller.

* * * * *